US010315830B2

(12) United States Patent
Mühlemann

(10) Patent No.: US 10,315,830 B2
(45) Date of Patent: Jun. 11, 2019

(54) METERING DEVICE MADE OF PLASTICS MATERIAL

(71) Applicant: Mühlemann IP GmbH, Stein am Rhein (CH)

(72) Inventor: Rolf Mühlemann, Schlattingen (CH)

(73) Assignee: Mühlemann IP GmbH, Stein am Rhein (CH)

( * ) Notice: Subject to any disclaimer, the term of this patent is extended or adjusted under 35 U.S.C. 154(b) by 133 days.

(21) Appl. No.: 15/506,876

(22) PCT Filed: Jul. 13, 2015

(86) PCT No.: PCT/EP2015/065951
§ 371 (c)(1),
(2) Date: Feb. 27, 2017

(87) PCT Pub. No.: WO2016/030073
PCT Pub. Date: Mar. 3, 2016

(65) Prior Publication Data

US 2017/0253412 A1 Sep. 7, 2017

(30) Foreign Application Priority Data

Aug. 27, 2014 (CH) ..... 1296/14

(51) Int. Cl.
*B65D 25/08* (2006.01)
*B65D 81/32* (2006.01)
(Continued)

(52) U.S. Cl.
CPC ..... *B65D 81/3211* (2013.01); *B65D 41/20* (2013.01); *B65D 47/38* (2013.01);
(Continued)

(58) Field of Classification Search
CPC .... B65D 81/3211; B65D 41/20; B65D 47/38; B65D 49/12; B65D 51/2835; B65D 25/08
(Continued)

(56) References Cited

U.S. PATENT DOCUMENTS 4,693,366 A * 9/1987 Goncalves ..... B65D 81/3211 206/222
8,356,711 B2 * 1/2013 Canziani Hoffa ... B65D 47/243 206/222
(Continued)

FOREIGN PATENT DOCUMENTS

CN 1081360 A 2/1994
CN 1094608 A 11/1994
(Continued)

OTHER PUBLICATIONS

International Search Report for PCT/EP2015/065951 dated Oct. 15, 2015 for PCT/EP2015/065951 filed Jul. 13, 2015.
(Continued)

*Primary Examiner* — Rafael A Ortiz
(74) *Attorney, Agent, or Firm* — Paul D. Bianco; Gary S. Winer; Fleit Gibbons Gutman Bongini & Bianco PL

(57) ABSTRACT

The metering device includes a metering container which can be fitted with screwing action on a standard bottle neck. The metering container has a funnel-shaped base, which is adjoined by a cylindrical lateral wall having, at the upper end, a cross-sectionally u-shaped collar, to which a cover surface can be applied in a form-fitting manner. At the top of the metering device is a pressure-exerting head with an encircling, detachable periphery. A puncturing mechanism having a two-part pressure-exerting pin can be actuated by the pressure-exerting head. The puncturing mechanism is fixed to the cover surface, prior to initial use, and is separated out of the cover surface by a cylindrical casing wall on the pressure-exerting head. The second part of the
(Continued)

puncturing mechanism has a punching sleeve, which severs membranes which close the metering container, whereupon the contents of the metering container can be supplied into the bottle.

14 Claims, 5 Drawing Sheets

(51) Int. Cl.

| | |
|---|---|
| ***B65D 41/20*** | (2006.01) |
| ***B65D 47/38*** | (2006.01) |
| ***B65D 49/12*** | (2006.01) |
| ***B65D 51/28*** | (2006.01) |
| *B65D 41/02* | (2006.01) |
| *B65D 47/36* | (2006.01) |
| *B65D 51/18* | (2006.01) |
| *B65D 51/20* | (2006.01) |
| *B65D 51/22* | (2006.01) |
| *B65D 51/24* | (2006.01) |

(52) U.S. Cl.
CPC ..... *B65D 49/12* (2013.01); *B65D 51/2835* (2013.01); *B65D 41/02* (2013.01); *B65D 47/36* (2013.01); *B65D 51/18* (2013.01); *B65D 51/20* (2013.01); *B65D 51/22* (2013.01); *B65D 51/24* (2013.01); *B65D 51/28* (2013.01); *B65D 51/2807* (2013.01); *B65D 51/2814* (2013.01); *B65D 51/2828* (2013.01); *B65D 81/32* (2013.01)

(58) Field of Classification Search
USPC ..... 206/219, 222; 222/80, 81, 82, 83, 83.5; 215/DIG. 8, 227, 228, 250, 257
See application file for complete search history.

(56) References Cited

U.S. PATENT DOCUMENTS

| | | | | |
|---|---|---|---|---|
| 2006/0151418 | A1* | 7/2006 | Scott | B65D 47/127 215/257 |
| 2008/0290060 | A1* | 11/2008 | Ammann | B65D 47/123 215/228 |
| 2010/0163578 | A1 | 7/2010 | Mueller et al. | |
| 2010/0187142 | A1* | 7/2010 | Lee | B65D 47/243 206/219 |
| 2010/0276308 | A1* | 11/2010 | Lee | B65D 51/2864 206/219 |
| 2013/0228482 | A1* | 9/2013 | Son | A45D 34/00 206/219 |
| 2013/0292275 | A1* | 11/2013 | Smart | B65D 51/2835 206/222 |
| 2013/0336085 | A1 | 12/2013 | Drake et al. | |
| 2015/0217924 | A1* | 8/2015 | Cho | B65D 51/2892 206/219 |

FOREIGN PATENT DOCUMENTS

| | | | |
|---|---|---|---|
| CN | 201235991 | Y | 5/2009 |
| EP | 2423124 | A1 | 2/2012 |
| EP | 2674373 | A1 | 12/2013 |
| GB | 2471994 | A | 1/2011 |
| JP | 2006176193 | A | 7/2006 |
| WO | 2008002160 | A2 | 1/2008 |
| WO | 2011/124946 | A1 | 10/2011 |
| WO | 2011124946 | A1 | 10/2011 |

OTHER PUBLICATIONS

Written Opinion dated Mar. 3, 2016 for PCT/EP2015/065951 filed Jul. 13, 2015.
English translation of the Written Opinion dated Jan. 3, 2017 for PCT/EP2015/065951 filed Jul. 13, 2015.
English translation of the International Preliminary Report dated Feb. 28, 2017 for PCT/EP2015/065951 filed Jul. 13, 2015.
Chinese Office Action dated Jun. 1, 2018 for Application No. 201580046225.3 with English summary.

* cited by examiner

METERING DEVICE MADE OF PLASTICS MATERIAL

FIELD OF THE INVENTION

The present invention relates to a metering device made out of plastic, which can be placed onto a bottleneck to form a tight seal, with a metering container, which on its outlet-side end is sealed prior to initial opening by means of a cover surface with drinking spout tightly placed on the opposing, actuation-side end, wherein the drinking spout has passed through it a pressure pin, which is operatively connected with a piercing mechanism, and that two concentric annular walls are molded onto the metering container, wherein the outer annular wall is provided with an internal thread, and wherein the pressure pin is further joined with a pressure head.

BACKGROUND

For about twenty years, development has been underway on metering devices combined with seals for bottles or plastic containers for dispensing liquid or free-flowing substances into the bottles or containers onto which these metering devices are applied. Even though, as already noted above, such metering devices were already developed roughly twenty years ago, the latter have only been on the market for a little while. The initial idea was to offer medication together with a relatively small bottle, so that a traveler could take his or her medication together with a beverage without having to give any special thought to corresponding beverages or first having to go into a restaurant to obtain a corresponding, suitable beverage. This initial idea has today been largely abandoned. Such metering devices made out of plastic are today being offered for a great many, varied, liquid, free-flowing or even solid active substances present in tablet form. They make it possible to precisely maintain a specific mixing ratio of active substance to bottle contents. For example, plant fertilizers continue to be offered in relatively large bottles or containers, which then are to be added in small liquid doses. For example, only an amount of 10 milliliters of a plant protection product or insecticide, pesticide or fungicide has to be added to a watering can with five liters of water. A threaded lid is most often used as a measuring cup when such an amount is to be dispensed from a two-liter plastic bottle. Experience shows that these measuring cups are hardly used, and a user meters by eye, and hence practically always meters too much. This is ecologically and economically disadvantageous.

Metering closures suitable for dispensing active substances in solid form most often have a somewhat more complex structural design, since these active substances are most often present in blister packs, so that the latter are protected against light and moisture until the time they are to be dispensed into a liquid. In particular in the case of beverages, these active substances are vitamins, which are not stable in the liquid phase, and also decompose when exposed to light. WO2008/002160 shows a typical example of such metering closures. In such metering closures, the blister pack is most often configured and dimensioned in such a way that its welded edge is non-positively and positively held with the threaded part of the seal between a bottleneck and lateral wall of the closure part. The tablet in the blister pack can be ejected by means of a piercing mechanism, which is held above the blister pack and can be actuated by a guided pressure head. A protective cap is most often held over the piercing mechanism and pressure head, and must be removed prior to initial actuation.

If the content to be dispensed in such a metering device is liquid or free-flowing, use is usually made of a device having a cap that incorporates a sealed chamber, and this chamber is opened by a relative movement between this chamber and a piercing mechanism, so that the content of the chamber gets into the container. For example, in a solution known from CN201235991Y, the piercing mechanism is fixedly secured to the lower part of this metering closure, and given an abductive movement of the sealing cap in which the sealed chamber is secured, the membrane that seals the chamber is cut open. A very similar metering closure with a receiving chamber in the cap of the closure is known from JP2006176193.

GB2471994A shows a metering device comprised of a lower closure part and an applied cap, wherein a chamber is here molded into the lower part of the metering closure, and incorporates a piercing mechanism that can be displaced into a lower position after removing a cap, and thereby punches open the metering chamber, which is closed at its lower end by a membrane.

All known metering devices with a metering container integrated therein are conceived in such a way that the metering container has a diameter exhibiting maximally the inner diameter of the bottleneck. If the metering container is secured to the upper part of the metering device, this diameter is again reduced by the wall thickness of the metering container.

For example, if a quantity of 50 milliliters is to be dispensed into a bottle having a bottleneck with an inner diameter of 22 millimeters, the metering chamber, or the metering container, would have to have a height of 13 centimeters. Bearing in mind that a piercing mechanism must also be present, which is to perform a certain stroke and exhibits a pressure head, it can be assumed that the height of such a metering device would practically have to measure 15 centimeters. However, this is unpractical and unusable in every aspect. Bearing in mind that a liter bottle has a height of over 35 centimeters, for example, and a metering device with a height of roughly 15 centimeters is to be applied hereon, there would have to be more than half a meter distance between two shelves in a sales rack. This would be completely uneconomical, and such a bottle would also be impractical to transport and also store in the household.

SUMMARY OF THE INVENTION

A metering device that is suitable for dispensing a larger volume into a bottle without significantly increasing the overall height is disclosed.

If a larger volume is ready for metered dispensing, not only can the unstable or light-sensitive content be stored in the metering container, or in the metering chamber, but space is then also available for additionally dispensing concentrated liquids, such as fruit concentrates, coffee concentrates, sugars or sweeteners.

In an embodiment, a metering device made out of plastic of the kind mentioned at the outset, is characterized in that the metering container has a floor designed as a funnel, whose outlet sleeve is comprised of the mentioned inner annular wall, and whose conical region of the funnel extends over the outer annular wall in a radial and axial direction, and the inner annular wall is molded onto the lower side of the conical region, and wherein the upper edge of the funnel adjoins a cylindrical wall, which continues downwardly as a circumferential skirting and extends until under the level of the two annular walls, and whose lower edge forms a standing surface, and wherein the metering container is further sealed by a cover surface comprised of pouring spouts, through which the piercing mechanism is passed.

It is most preferred that a push button be formed at the upper end of the piercing mechanism.

If this push button is shaped like a dome and the lower, circumferential edge region is made separable, this lower edge can, prior to initial use, rest on a circumferential collar on the cylindrical wall of the metering chamber designed as a funnel, and thereby comprise a closed and secured structure, wherein the circumferential lower edge region can then serve as a guarantee strip. In order to give the injection molds for manufacturing the metering device out of plastic the simplest possible design, it is expedient and advantageous to have the piercing mechanism consist of two parts, as disclosed in claim 4. Additional advantageous embodiments may be gleaned from the dependent claims. The drawing shows a preferred embodiment of the subject matter according to the invention, and explains it based upon the following specification. Shown on:

DETAILED DESCRIPTION OF THE INVENTION

The metering device is marked 1 overall. The term metering device was here selected instead of the term metering closure device. In metering closure devices, the latter is always marketed mounted on the corresponding bottle. This does not hold true in the case at hand. The metering device as such is here marketed, and can then be applied to a bottle with a standardized bottleneck. The metering device according to the invention is thus provided with means adjusted to the bottleneck, which will be touched upon further below.

Figure 5:
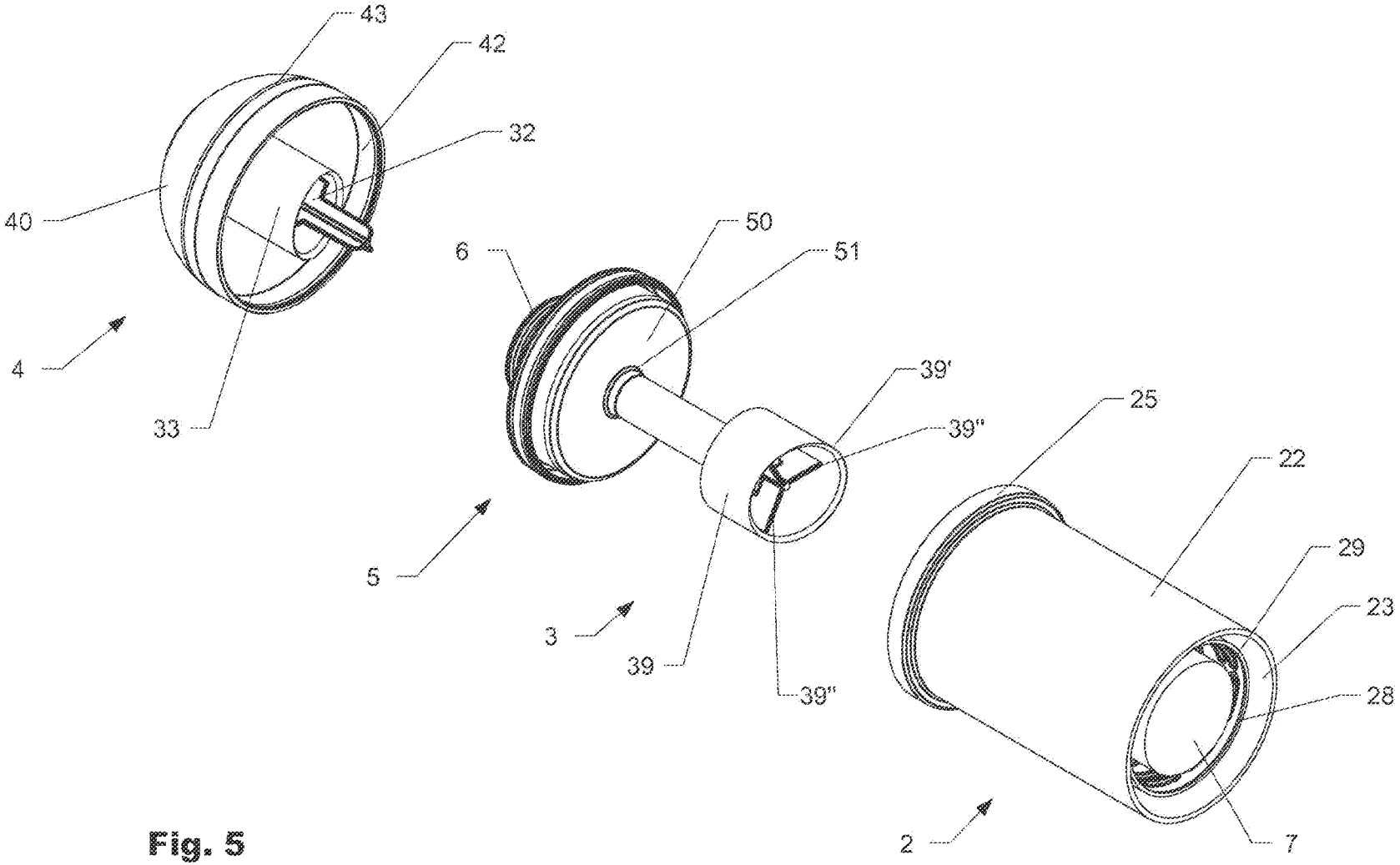
FIG. 5 is an exploded drawing of the metering device prior to initial actuation, while FIG. 6 once again is an exploded drawing of the metering device after initial use as depicted on FIGS. 3 and 4.
Figure 6:
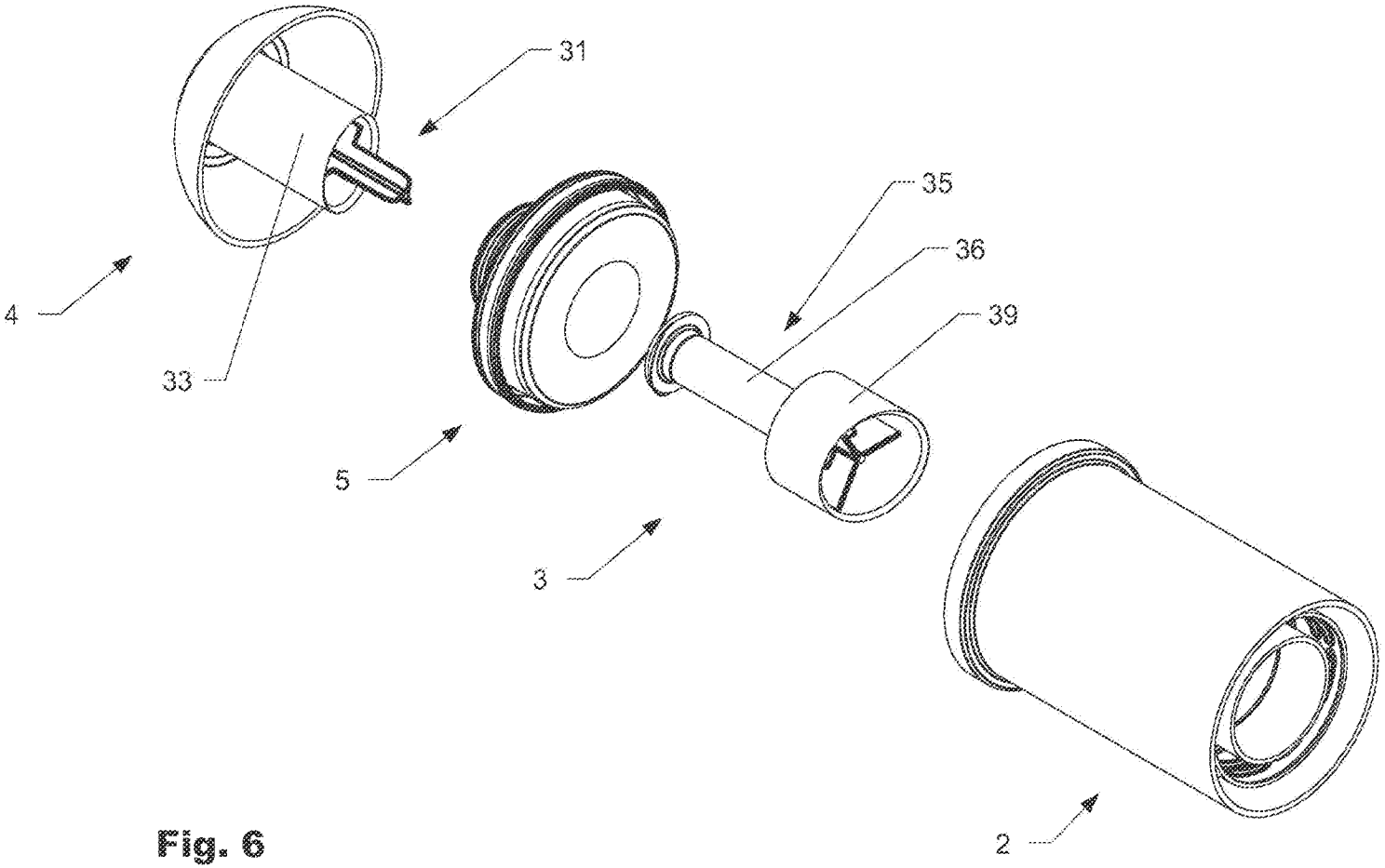

The metering device according to the invention essentially consists of three or four parts, as may be discerned from FIGS. 5 and 6. These parts are the metering container 2, the piercing mechanism 3, the pressure head 4 and the cover surface 5 of the metering container 2. As evident from FIG. 5, the piercing mechanism 3 and cover surface 5 can be fabricated as a single piece, and they are then only separated during initial use of the metering device. These individual parts will now be described in detail below.

The metering container 2 has a funnel-shaped floor 20. This funnel-shaped floor 20 exhibits an upper edge 21. In the following, the terms upper and lower are always understood to mean that upper always refers to the direction toward the pressure head 4, and below to the direction toward the connection means yet to be described for attachment to a bottleneck. A continuous lateral wall 22 adjoins this mentioned upper edge 21 of the funnel-shaped floor 20 as a single piece. This lateral wall 22 is downwardly elongated over the upper edge of the funnel-shaped floor 21 as an apron 23. This apron 23 defines a flat surface, which forms the standing surface 24 of the metering device. As already mentioned at the outset, these metering devices are preferably sold separately from the bottles upon which they are suitably attached. In principle, however, it would indeed also be possible for these metering devices to be marketed already mounted onto the bottle.

A collar 25 with a u-shaped cross section is molded on the upper end of the lateral wall 22. This u-shaped collar 25 forms a continuous channel 26, which serves to tightly and positively join the cover surface 5 with the metering container 2.

Two concentric annular walls are molded onto the lower side of the funnel-shaped floor 20. The inner annular wall 27 forms a pouring spout 27 of the metering container 2. An outer annular wall 28 running concentrically to the inner annular wall 27 is molded onto the lower side of the funnel-shaped floor 20. Both annular walls 27, 28 end at the same height, but above the standing surface 24. The outer annular wall 28 exhibits an internal thread 29. Of course, this internal thread is tailored to the external thread of the bottleneck onto which the metering device 1 is to be screwed. In this regard, let it be briefly mentioned that a large number of liter and 1.5 liter bottles exhibit standardized threads. This applies both to PET bottles and glass bottles.

Figure 1:
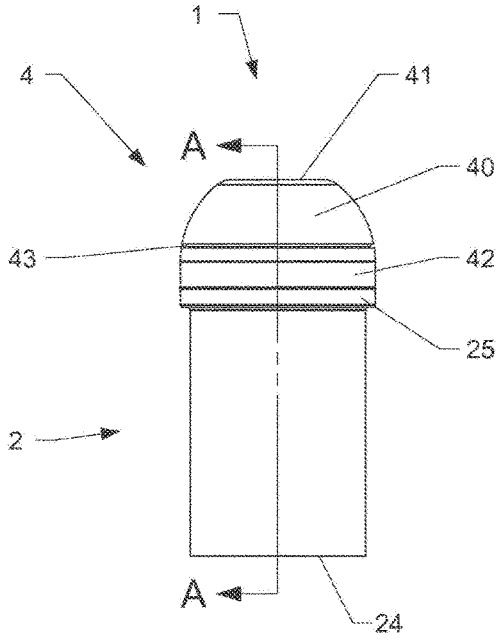
FIG. 1 is a side view of the metering device made out of plastic prior to initial actuation.

Placed onto the metering container 2 is the pressure head 4. This pressure head 4 exhibits an essentially cup- or dome-shaped pressure surface 40. This pressure surface 40 exhibits a flattened portion 41 at the very top. The spherically curved pressure surface 40 is downwardly adjoined by a continuous, cylindrical edge 42, which can be separated from the actual pressure surface 40. To this end, a separating seam 43 runs between the pressure surface 40 and continuous edge 42, and is formed either by a continuous thin point or by a plurality of predetermined breaking point bridges. The continuous edge 42 is severed and a pull tab is molded onto the side facing away on FIG. 1. The continuous, separable edge 42 thus serves as a guarantee strip prior to initial use, which ensures and makes discernible that the metering device is unused. The initial actuation can take place only after the continuous edge 42 has been severed. The term initial actuation is here somewhat misleading, however, but indeed used for such metering devices, even though the metering device only serves for one-time use, so that only an initial actuation takes place, and in no way a repeated use.

Prior to first use, the lower edge of the separable, continuous edge 42 rests at the very outside on the u-shaped collar 25. After the continuous edge 42 has been severed, the lower edge of the dome-shaped pressure surface 40 then also at the very outside rests on the u-shaped collar 25.

A first part 30 of the piercing mechanism 3 is molded on underneath the pressure surface 40, in the example shown here underneath the flattened portion 41 of the pressure head 4. This first part 30 of the piercing mechanism 3 is formed by a first part 31 of a pressure pin, which consists of two parts in all. Only this first part 31 of the pressure pin is molded onto the pressure head as a single piece. The pressure pin here consists of three star-shaped, radially outwardly directed guiding walls 32, which are peripherally molded onto a cylindrical enveloping wall 33 as a single piece. This cylindrical enveloping wall 33 is cut at an angle at the very bottom, and its lower edge exhibits a separating blade 34. The significance of this separating blade 34 has yet to be described below. The guiding walls 32 are shortened at the lower end in a radial direction, and there engage into a second part 35 of the piercing mechanism 3. This second part 35 of the piercing mechanism 3 exhibits a tubular section 36. This tubular section 36 exhibits a lower, closed end 37. A continuous collar 38 is molded onto the upper end of the tubular section 36. A punching sleeve 39 is molded onto the lower, closed end 37 of the tubular section 36. This punching sleeve is cylindrical and mounted so that it can slide in the interior annular wall 27, which comprises the pouring spout $\mathbf{27}^{I}$. The punching sleeve 39 is in turn cut at an inclination to its central axis, and exhibits a blade $\mathbf{39}^{I}$ at the lower edge. The punching sleeve 39 is joined with the tubular sleeve 36, or with its lower, closed end 37, by means of at least one radially outwardly directed connecting wall $\mathbf{39}^{II}$, with the punching sleeve 39.

The metering container 2 is sealed at its upper end by a cover surface 5. This cover surface 5 has a pot-shaped configuration. As illustrated here and most preferably realized, the floor 50 of this pot-shaped cover surface 5 can be joined as a single piece with the continuous collar 38 and tubular section 36. Since the tubular section 36 is also sealed at the bottom, the floor 50 in conjunction with the continuous collar 38 and tubular section 36 comprise a closed termination of the metering container 2. The continuous collar 38 is tightly joined by means of a perforation skin 51 with the floor 50 of the pot-shaped cover surface 5. An upwardly directed, annular wall forms a drinking spout 6 that adhesively adjoins the outermost edge of the perforation skin 51. This drinking spout 6 incorporates the cylindrical enveloping wall 33, which together with the guiding walls 32 forms the first part 31 of a pressure pin.

An outer, continuous pot wall 52 borders the floor 50 of the cover surface 5, which has a pot-shaped design. Its upper cross section is bent like a hairpin. This bent part 53 engages into the continuous channel 26 of the collar 25 a u-shaped cross section. The outer or inner wall of the channel 26 exhibits corresponding positive locking means, and the bent part 53 of the pot wall exhibits corresponding diametrically opposed positive locking means, so that the cover surface 5 is irreversibly and fixedly joined with the metering container 2. The pressure head 4 also has corresponding positive locking means both on the continuous, separable edge 42, and above the separating seam 43 in the curved region of the pressure surface 40, which are removably connected with diametrically opposed positive locking means on the upper, outer edge of the bent part 43 with diametrically opposed positive locking means.

Finally, the metering container 2 is sealed by means of a membrane 7 before the initial opening. This membrane is welded or adhesively bonded to the inner annular wall 27.

In the preferred embodiment described here, the second part 35 of the piercing mechanism 3 is fabricated so as to be joined as a single piece with the cover surface 5, as described above in detail. However, it is certainly possible to fabricate the second part 35 of the piercing mechanism 3 separately from the cover surface 5. In this case, an annular film is adhesively bonded or welded under the cover surface 5, which is likewise welded or adhesively bonded with the continuous collar 38, and thereby also yields a sealing and retaining connection between these two parts. Given such a solution, the tubular section 36 and punching sleeve 39 would then advantageously be fabricated as separate parts that can be snapped together, to in this way be able to apply the annular film.

Finally, stiffening ribs 54 can be molded onto the floor 50 of the cover surface 5, which are joined with the drinking spout 6.

The outer wall of the punching sleeve 39 can also exhibit a continuous retaining bead, for example, and the interior side of the inner annular wall 27 can exhibit a diametrically opposed retaining groove, which engage into each other once the lowermost position of the punching sleeve has been reached, thereby securing the punching sleeve in this position so as to prevent the second part 35 of the piercing mechanism 3 to fall into a bottle. However, this should likely not be necessary in most instances, since the first part 31 of the pressure pin is positively held in the tubular section 36.

Figure 7:
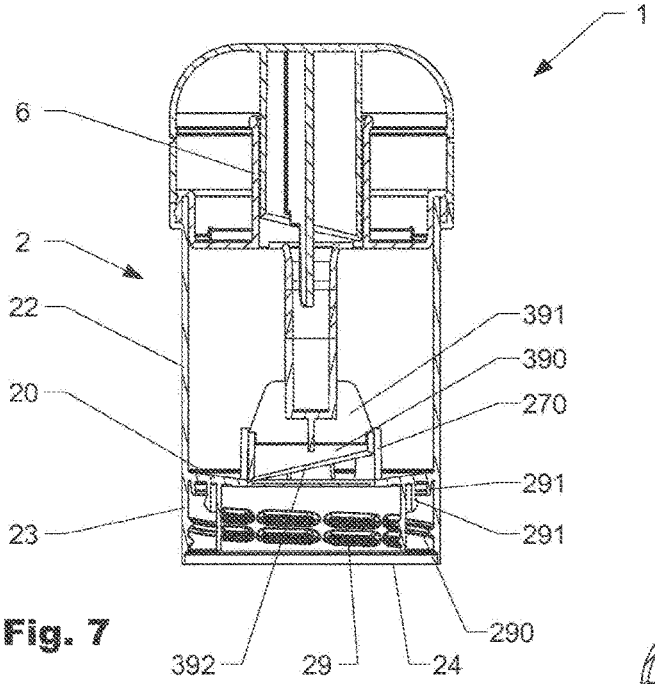
FIG. 7 shows an alternative embodiment of the metering device, which can be placed on a sealed bottleneck, in the position prior to initial opening, and FIG. 8 the same embodiment in the same view after initial opening.
Figure 8:
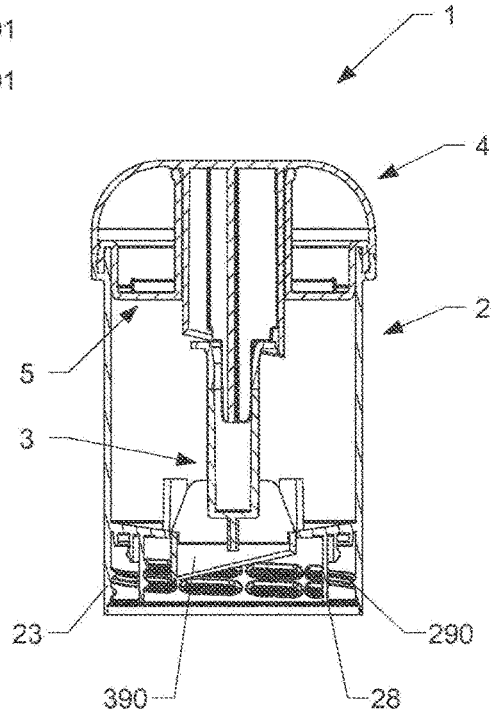
Figure 9:
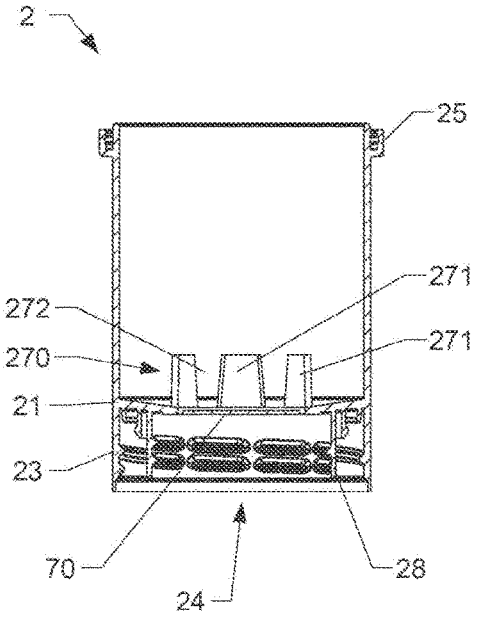
FIG. 9 is the metering device taken by itself, also in a diametric section.

FIGS. 7-9 show an alternative embodiment of the metering device 1 according to the invention. The pressure head 4, the cover surface 5 and the drinking spout 6 here remain unchanged. By contrast, the metering chamber 2 and piercing mechanism 3 along with the membrane 7 have been slightly modified. This will now be taken up in detail below.

Remaining unchanged here are the lateral wall 22 and apron 23 adjoining it, which is configured as a lower elongation of the lateral wall 22. A slight change here involves only the inclination of the funnel-shaped floor 20, which here is only slightly inclined in design with a tightening angle of roughly 5 to 10°. As particularly conspicuous, however, the inner annular wall 27 now marked 270 is no longer directed from the edge of the outlet of the floor 20 downwardly toward the standing surface 24, but rather upwardly into the interior of the metering container 2. This inner annular wall 270 is segmented, so that the content can still flow out of the metering container 2 anyway. Correspondingly, the inner annular wall 270 is comprised of friction ring wall elements 271, between which recesses 272 are pulled down up to the edge of the outlet in the floor 20. This solution is correspondingly especially well-suited for the job of liquid active substances. Thanks to this solution, the membrane here marked 70 can now be sprayed as a single piece with the floor 20. This membrane 70 is so thin-walled in design that the piercing mechanism 3 can be punched out by means of its punching sleeve 39, which is here marked 390, upon actuation of the piercing mechanism 3. This solution is conceived especially for application onto a bottleneck that itself is in turn hermetically sealed by means of a membrane applied to the bottleneck.

The metering device is in turn screwed onto a now sealed bottleneck. To prevent the inner annular wall 27 from already destroying the membrane on the bottleneck in the screwing process, this inner annular wall now marked 270 is upwardly directed, as described above. A downwardly directed annular wall is now also no longer required, since a seal for the bottleneck during transport and storage is no longer needed, as the bottle already is and remains hermetically sealed, as mentioned.

This solution now requires that the punching sleeve 30 has to be shortened in its axial alignment. This shortened punching sleeve 39 is thus marked 390. Prior to the initial actuation as depicted on FIG. 7, the shortened punching sleeve 390 now lies completely inside of the upwardly displaced inner annular wall 270. As already mentioned, the membrane 70 integrally fabricated with the floor 20 can thus be displaced onto the plane that binds the outlet of the metering container 2 after the membrane 70 was separated out. Since as already mentioned the inner annular wall 270 is divided into partial annular wall elements 271 by recesses 272 that extend downwardly up to the floor 20, the content can be discharged completely from the metering container 2.

After the membrane 70 the blade 392 at the lower edge of the shortened punching sleeve 390 has punched through the membrane 70, it then punches through the membrane (not shown in the drawing) on the bottleneck on which the metering device 1 is screwed. The internal thread 29 on the outer annular wall 28 along with the inclined running floor 20 now abut tightly enough against the bottleneck that no additional seals are required.

Since the punching sleeve 390 is shortened by comparison to the previously described solution, the connecting walls 391 run largely outside of the punching sleeve 390, and extend from the latter upwardly toward the closed end 37 of the tubular section 36, as well as toward the wall of this tubular section 36.

Also shown here as simply one other option is that the apron 23 can be configured with an internal thread 290. This also makes it possible to secure the metering device 1 according to the invention to a bottle with an especially wide bottleneck. As a result, the metering device can be connected onto bottles with varying bottleneck diameters.

Figure 2A:
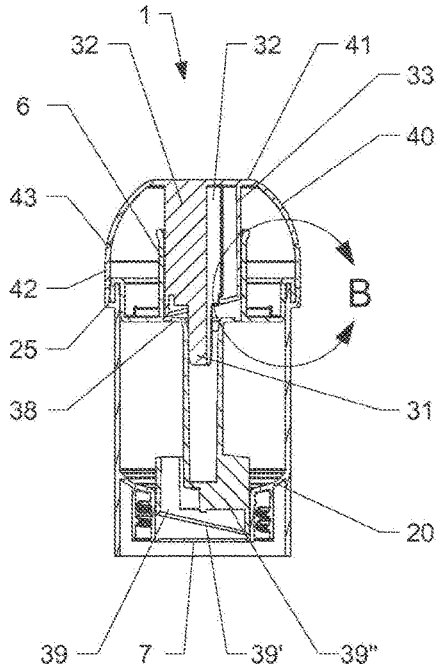
FIG. 2*a* is a diametric section of the metering device according to FIG. 1, cut along the C-C line.
Figure 2B:
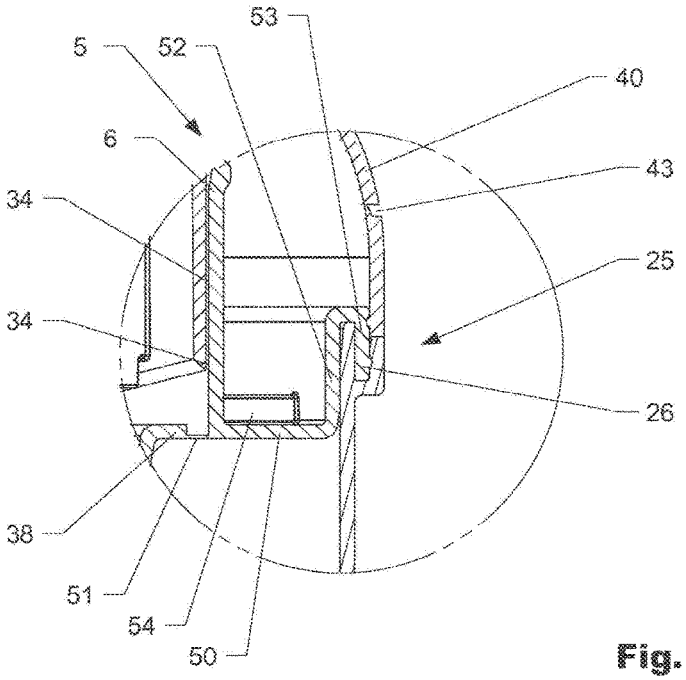
FIG. 2*b* is the circled detail from FIG. 2 on a magnified scale, FIG. 3 once again is a side view of the metering device according to FIG. 1, but after initial actuation, and correspondingly FIG. 4*a* once again is a diametric section of the metering device according to FIG. 3 along the D-D line, wherein FIG. 4*b* once again is the detail circled on FIG. 4 on a magnified scale.
Figure 3:
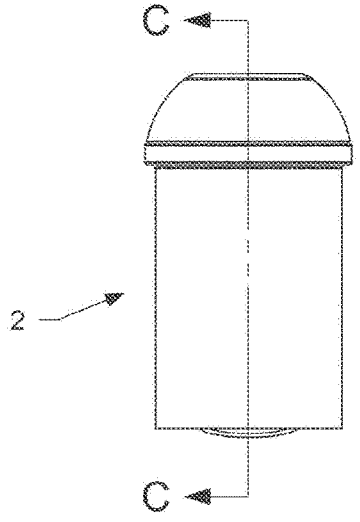
Figure 4A:
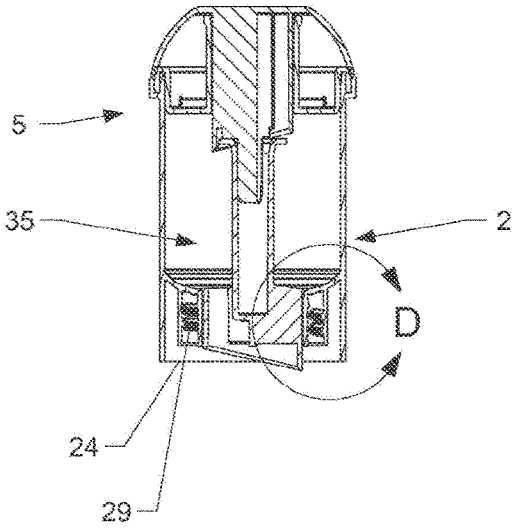
Figure 4B:
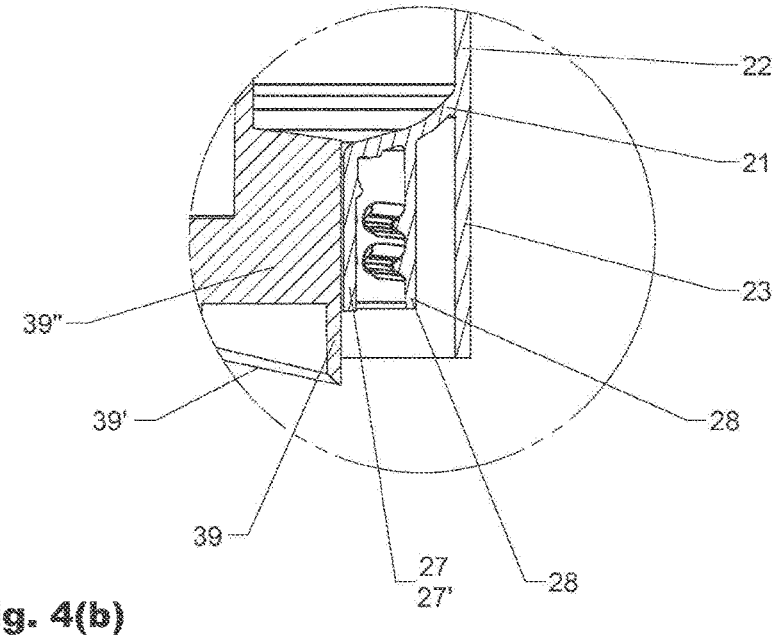

The use of the metering device according to the invention will now be briefly described below. If the objective is to apply the contents of the metering device 1 according to the invention in a standardized liter bottle, the threaded closure located thereon is first unscrewed. The metering device is now screwed onto the bottle. The bottleneck comes to lie between the inner annular wall 27 and outer annular wall 28 in the process. The thread 29 fits onto the thread of the standardized liter bottle. Once the metering device 1 has been screwed on, the detachable, continuous edge 42 of the pressure head 4 is removed. This pressure head with detached edge 42 is clearly visible on FIG. 6. By now pressing on the pressure head 4, the cylindrical enveloping wall 33 is made to impact the perforation skin 51, as evident on FIG. 2*a*. As a consequence, the continuous collar 38 and part of the tubular section 36 are pressed out of the floor 50 of the cover surface 5, severing the perforation skin 51. The cylindrical enveloping wall 33 that presses onto the mentioned perforation skin does not necessarily require a blade for this purpose. However, in cases involving a connection by means of an adhesively bonded or welded film, it makes sense to configure the cylindrical enveloping wall on the lower edge as a separating blade 34. The latter can here also be equipped with a perforating tooth (not shown here). When pressing down the pressure head 4, the first part 31 of the pressure pin situated inside of the cylindrical enveloping wall 33 of course also begins to move downward, and thus also hits the second part of the pressure pin 35, which is designed as a tubular section 36, downwardly with the punching sleeve 39. This punching sleeve here cuts through the adhesively bonded or welded on membrane 7. Since the punching sleeve 39 is open on both sides, a communicating connection is now established between the metering container 2 and interior of the bottle. The contents of the metering container 2 thereby get into the bottle.

As already mentioned at the outset, the inner diameter of the metering container 2 need in no way match the bottleneck, but thanks to the funnel-shaped floor 20 of the metering container 2 is far larger in diameter than the inner diameter of the bottleneck. This means that far larger quantities can be dispensed without any problem, despite the lower overall height. Since the interior of the metering container also has a communicative connection with the bottle after initial opening, this content can be larger than the hollow space still to be filled in the bottle when the latter is in its original fill state. The two communicating spaces of the metering chamber 2 and bottle now both still remain tightly sealed by the cover surface 5 and cylindrical enveloping wall 33, which is molded closed on the pressure head 44. Only once the cover surface 44 of the pressure head 4 is open can the user now drink the contents directly through the drinking spout 6, or pour it out through the drinking spout. As opposed to the known metering devices, which are only able to dispense at most roughly 10 milliliters in content, it is now possible to also add a content of 50 to even 100 milliliters to the bottle content. This yields completely new possible applications. In this way, fruit concentrates can be added to mineral water or an isotonic beverage in high dosages, wherein the percentage in the metering container 2 protected against light remains so until added, while the light-insensitive beverage in the bottle can be delivered.

REFERENCE LIST

1 Metering device
2 Metering container
3 Piercing mechanism
4 Pressure head
5 Cover surface of metering container
6 Drinking spout
7 Membrane
20 Funnel-shaped floor
21 Upper edge of funnel-shaped floor
22 Lateral wall
23 Apron as lower elongation of lateral wall
24 Standing surface
25 U-shaped collar
26 Continuous channel
27 Inner annular wall
27$^{I}$ Pouring spout
28 Outer annular wall
29 Internal thread
30 First part of piercing mechanism 3
31 First part of a pressure pin
32 Guiding walls
33 Cylindrical enveloping wall
34 Separating blade
35 Second part of piercing mechanism 3
36 Tubular section ad second part of pressure pin
37 Lower closed end of tubular section 36
38 Continuous collar at upper end of tubular section 36
39 Punching sleeve
39$^{I}$ Blade of punching sleeve
39$^{II}$ Connecting wall
40 Pressure surface
41 Flattened portion
42 Continuous edge, separable
43 Separating seam
50 Floor of cover surface
51 Perforation skin
52 Pot wall of cover surface 5
53 Bent part of pot wall
54 Stiffening ribs
70 Membrane

270 Inner annular wall, upwardly displaced
271 Partial ring wall elements
272 Recesses
291 Sealing elements between 23 and 28
390 Shortened punching sleeve
391 Connecting walls
392 Blade of punching sleeve 390

The invention claimed is:

1. A metering device made out of plastic, which is configured for placement onto a bottleneck to form a tight seal, comprising a metering container, which prior to initial opening is sealed at one end by a membrane, and on the opposing end with a tightly placed cover surface with drinking spout, wherein two concentric annular walls are molded onto a funnel-shaped floor, wherein the outer annular wall is provided with an internal thread, and that further the metering container is formed by the funnel-shaped floor and a cylindrical lateral wall, whose inner surface is larger in diameter than the outer surface of the outer annular wall, and the lateral wall adjoins at the upper edge of the floor designed as a funnel, while the lateral wall continues as a continuous apron under the edge, and extends until under the level of the two annular walls, and the lower edge of the apron forms a standing surface of the metering device before application onto a bottleneck, wherein the drinking spout has passed through it a pressure pin, which is operatively connected with a piercing mechanism, and joined with a pressure head.

2. The metering device according to claim 1, wherein the pressure head is dome-shaped in design, and a lower continuous edge prior to initial use rests on a continuous u-shaped collar on the lateral wall of the metering container, and wherein the lower, continuous edge of the pressure head is separable.

3. The metering device according to claim 1, wherein the piercing mechanism is made of two parts, wherein the first part of the piercing mechanism is molded onto the surface of the pressure head directed toward the metering container and comprises a first part of the pressure pin, and the second part of the piercing mechanism is a second part of the pressure pin designed as a tubular section, into which the first part of the pressure pin engages, and wherein a punching sleeve open on both sides and engages into the tubular section at a lower end of the tubular section.

4. The metering device according to claim 3, wherein the tubular section exhibits a continuous collar at an upper end of the tubular section, which is separably joined with the cover surface prior to initial use.

5. The metering device according to claim 4, wherein the continuous collar of the tubular section is joined as a single piece with the cover surface by a destructible perforation skin.

6. The metering device according to claim 4, wherein the continuous collar of the tubular section is joined with the cover surface by an adhesively bonded or welded on film.

7. The metering device according to claim 3, wherein a cylindrical enveloping wall that slides in the drinking spout is provided with a separating blade.

8. The metering device according to claim 7, wherein the separating blade is comprised of an inclined sectional plane that runs toward a central axis of the enveloping wall.

9. The metering device according to claim 7, wherein the separating blade runs in a sectional plane running perpendicular to a central axis of the enveloping wall, and wherein at least one perforating tooth is molded onto a cutting edge.

10. The metering closure according to claim 3, wherein the tubular section is closed at the lower end.

11. The metering closure according to claim 3, wherein the cylindrical punching sleeve open on both sides is molded onto the lower end of the tubular section by at least one radially outwardly directed connecting wall, and can be used to punch through the membrane that seals the metering container.

12. The metering device according to claim 1, wherein the membrane that seals the metering container is secured to the lower edge of the inner annular wall.

13. The metering device according to claim 4, wherein the membrane is molded onto the lower edge of the inner annular wall as a single piece.

14. The metering device according to claim 1, wherein the inner annular wall extends upwardly from the floor of the metering container into the metering container, and is divided into partial annular wall elements by recesses, wherein a punching sleeve prior to initial use lies completely inside the outer annular wall into which the punching sleeve is guided during initial use.

* * * * *